United States Patent [19]

Tokosh et al.

[11] 4,180,470

[45] Dec. 25, 1979

[54] METHOD FOR IMPROVED ACYL ISETHIONATE DETERGENT BARS

[75] Inventors: Richard Tokosh, Saddle Brook; Arno Cahn, Pearl River, both of N.J.

[73] Assignee: Lever Brothers Company, New York, N.Y.

[21] Appl. No.: 872,298

[22] Filed: Jan. 25, 1978

Related U.S. Application Data

[63] Continuation of Ser. No. 782,698, Mar. 20, 1977, abandoned.

[51] Int. Cl.[2] ..... C11D 10/04; C11D 1/28; C11D 1/14

[52] U.S. Cl. ..... 252/121; 252/134; 252/174; 252/554; 252/557; 252/DIG. 16

[58] Field of Search ..... 252/554, 551, 557, 174, 252/121, 134, DIG. 16

[56] References Cited

U.S. PATENT DOCUMENTS

| | | | |
|---|---|---|---|
| 2,356,903 | 8/1944 | Wood | 252/550 |
| 2,894,912 | 7/1959 | Geitz | 252/DIG. 16 X |
| 2,987,484 | 6/1961 | Lundberg et al. | 252/551 X |
| 2,988,511 | 6/1961 | Mills | 252/121 |
| 2,991,253 | 7/1961 | Sheely et al. | 252/121 |
| 3,070,547 | 12/1962 | Chaffee | 252/121 |
| 3,267,040 | 8/1966 | Bright | 252/554 |
| 3,376,229 | 4/1968 | Haass et al. | 252/557 X |
| 3,951,842 | 4/1976 | Prince et al. | 252/DIG. 16 X |
| 4,007,125 | 2/1977 | Prince | 252/554 X |

*Primary Examiner*—Harris A. Pitlick

*Attorney, Agent, or Firm*—Kenneth F. Dusyn; James J. Farrell

[57] ABSTRACT

This invention relates to a detergent bar having superior use properties and comprising acyl isethionate as the major detergent surface active agent with an unesterified water-soluble alkali metal isethionate as a bar processing aid. Adding an alkoxy hydroxy propane sulfonate in conjunction with a small amount of sodium chloride to these toilet detergent bars significantly reduces the wear rate of the bar without adversely affecting its lathering characteristics.

11 Claims, No Drawings

METHOD FOR IMPROVED ACYL ISETHIONATE DETERGENT BARS

This is a continuation of application Ser. No. 782,698, filed Mar. 20, 1977, now abandoned.

BACKGROUND

The present invention is concerned with an improvement in the lathering and wear rate properties of a toilet detergent bar having an acyl isethionate as the predominate surface-active detergent and an unesterified water-soluble alkali metal isethionate as a bar processing aid.

One of the problems of acyl isethionate toilet detergent bars is their unusually high wear rate despite the attention given to other properties of this type of bar. For example, in U.S. Pat. No. 4,007,125, incorporated herein by reference, it was found that the mush properties of an acyl isethionate detergent bar could be improved by adding to the bar an amount of sodium alkane sulfonate wherein the alkane group has 12 to 14 carbon atoms. And in application Ser. No. 428,287, filed Dec. 26, 1973, now abandoned, the mush properties of the same kind of bar are improved by the addition of a mixture of sodium sulfate and sodium chloride. However, regardless of the improvement in the mush properties obtained with the detergent bars according to these applications, the wear rate of these bars still remains a problem, and any attempt to improve this latter property has heretofore been accomplished at the expense of lathering.

The use of alkoxy hydroxy propane sulfonates in soap bars has been described in U.S. Pat. No. 2,987,484 issued on June 6, 1961, wherein sodium and potassium alkyl glyceryl ether sulfonates have been incorporated in soap bars as anionic surface active agents in amounts of 35% and above. And in U.S. Pat. No. 2,988,511, issued on June 13, 1961, alkyl glyceryl ether sulfonates are described as major anionic detergent actives, which can be used in combination with the isethionates. The lathering boosting properties of alkyl glyceryl ether sulfonate compounds, however, when used in relatively small amounts with acyl isethionates as the major surfactant have not been recognized.

BROAD DESCRIPTION

It has now been discovered that the incorporation of a relatively small proportion of sodium alkoxy hydroxy propane sulfonate and a small amount of sodium chloride in a predominantly acyl isethionate detergent bar having an unesterified water-soluble alkali metal of isethionic acid as a bar processing aid will significantly decrease the wear rate of the bar without adversely affecting its lathering properties and processing characteristics. The term "predominant", as used in connection with the proportion of acyl isethionate, means that the proportion of acyl isethionate is not exceeded by any other surface active agent in the composition.

The present invention is particularly useful in that a more economical acyl isethionate detergent bar with less than the usual free isethionate salt can be made and marketed while the bar still maintains its excellent lathering properties.

DETAILED DESCRIPTION

The present application is applicable to toilet detergent bars of the type disclosed and claimed in U.S. Pat. No. 2,894,912 issued on July 14, 1959, and U.S. Pat. No. 3,376,229 issued on Apr. 2, 1968, which patents are incorporated herein by reference. The major surface active agent in the detergent bar according to this application are aliphatic higher fatty acid esters of an alkali metal isethionic acid salt, which are hereinafter referred to as acyl isethionates. The acyl isethionate will comprise from about 30 to 70% of the bar and can be defined by the following general formula:

$$RCOOCH_2CH_2SO_3M$$

wherein R is an aliphatic radical or mixed aliphatic radical of a higher fatty acid, or mixtures thereof, having from 6 to 18 carbon atoms and an iodine value of less than about 20; and wherein M is an alkali metal cation such as sodium, potassium or ammonium, or the cation of an organic amine base such as triethanolamine, triisopropanolamine, diethanolamine and monoethanolamine. The composition of the detergent bar can also contain from 2 to 10% of at least one water-soluble suds-boosting detergent salt selected from the group consisting of alkali metal and organic amine higher aliphatic fatty alcohol sulfates, an alkyl aryl sulfonate and a higher aliphatic fatty acid tauride, from about 1% to about 9% water, from about 2.5% to about 25% of a water-soluble higher fatty acid soap, and from 10 to 40% of at least one higher fatty acid having from about twelve to about twenty-five carbon atoms as a binder and plasticizer, with the detergent bar having a pH within the range from 6 to 8, measured as a 10% aqueous solution of the bar composition at 35° C.

In addition, an unesterified water-soluble alkali metal salt of isethionic acid, such as sodium isethionate, is contained in the above detergent bar as a bar hardening and bar processing aid in an amount of from about 1% to about 7%.

Detergent bars according to the above formulation encounter various performance problems in that the wear rate is significantly higher than other known marketed soap and detergent bars. This wear rate, which is a measure of the loss in weight of the bar with usage, is largely due to the chemical properties of the bar. It has been discovered that by reducing the acyl isethionate/sodium isethionate in the detergent bar with a corresponding increase in binder and/or plasticizer, a reduction in wear rate can generally be obtained. However, when this is done, another property of the bar is sacrificed; specifically, the lathering properties of the bar will decrease. In addition, adding suds boosters or suds additives to make up this lathering loss demonstrated that when lathering parity had been obtained, the suds booster caused processing problems in the manufacture of the bar.

Applicants have discovered that good lathering characteristics can be imparted to acyl isethionate detergent bars of the type described above without adverse processing or manufacturing problems by adding a compound having the following formula:

$$CH_3-(CH_2)_n-CH_2-O-CH_2-\underset{\underset{OH}{|}}{CH}-CH_2-SO_3-M$$

wherein n is an integer from 6 to 18; and M can be calcium, magnesium, ammonium, sodium or potassium.

Excellent lathering characteristics can be obtained, for example, when sodium alkoxy hydroxy propane sulfonate is added as a suds booster to the acyl isethionate detergent bar formulation. In addition to the excellent lathering properties that can be obtained, it was found that incorporating from about 2 to 10% of the above defined alkoxy hydroxy propane sulfonate will not cause processing problems.

While the lathering and processing characteristics of the acyl isethionate detergent bar are improved by the addition of the alkoxy hydroxy propane sulfonate, the wear rate of the bar still remains significantly high. Applicants have discovered, however, that the wear rate of the above improved acyl isethionate bar can be substantially lowered by adding to the detergent bar, in addition to the alkoxy hydroxy propane sulfonate, sodium chloride in an amount of less than 1.2%. Normally, a drop in wear rate is accompanied by a reduction in lathering. While the sodium alkoxy hydroxy propane sulfonate/sodium chloride combination will significantly reduce the wear rate, the lathering characteristics of the improved acyl isethionate bars were unexpectedly equal or slightly superior to a detergent bar, such as that described in U.S. Pat. No. 3,376,229. Accordingly, the alkoxy hydroxy propane sulfonate/-sodium chloride combination, at the levels indicated hereinafter, will enable a more economical acyl isethionate detergent bar to be produced having improved wear rate while still maintaining the excellent lathering characteristics obtainable with the alkoxy hydroxy propane sulfonate.

In accordance with the improvement herein, then, a method is provided for reducing the wear rate of an acyl isethionate detergent bar having an unesterified water-soluble alkali metal isethionate as a bar processing aid, without adversely affecting the lathering properties or processing characteristics of the bar, by incorporating into the bar:

(a) from 1% to 10%, and preferably 2% to 6%, by weight of an alkoxy hydroxy propane sulfonate having the formula $$CH_3-(CH_2)_n-CH_2-O-CH_2-\underset{\underset{OH}{|}}{CH}-CH_2-SO_3-M$$

wherein n is an integer from 6 to 18; and M is sodium, potassium, calcium, or ammonium; and (b) less than 1.2%, preferably 0.1% to 1.0% and desirably 0.6% to 1.0%, of sodium chloride, the percentages being based on the total weight of the detergent bar produced.

The acyl isethionate detergent bar made according to the method described above can be prepared by conventional practices known to those skilled in the art of toilet and detergent bars, and will generally comprise from about 30% to 70% of an acyl isethionate of the general formula $$RCOOCH_2CH_2SO_3M$$

wherein R is an aliphatic radical or mixed aliphatic radical of a higher fatty acid, or mixtures thereof, having from six to eighteen carbon atoms and an iodine value of less than about 20; and wherein M is an alkali metal cation, such as sodium, potassium or ammonium, or the cation of an orgainic amine base, such as triethanolamine, tri-isopropanolamine, diethanolamine and monoethanolamine; and from about 1% to about 7% of an unesterified water-soluble alkali metal isethionate as a bar processing aid. The acyl isethionate detergent bar formed according to the method above may also contain from 2 to 10% of at least one water-soluble suds-boosting detergent salt selected from the group consisting of alkali metal and organic amine higher aliphatic fatty alcohol sulfates, an alkyl aryl sulfonate, and a higher aliphatic fatty acid tauride, from about 1% to about 9% water, from about 2.5% to about 25% of water-soluble higher fatty acid soap, and from 10 to 40% of at least one higher fatty acid having from about twelve to about twenty-five carbon atoms as a binder and plasticizer, with the finished detergent bar having a pH within the range from 6 to 8, measured as a 10% aqueous solution of the bar composition at 35° C.

Another aspect of the improvement herein is the provision of a detergent bar comprising (a) 1% to 10%, preferably 2% to 6%, by weight of an alkoxy hydroxy propane sulfonate of the formula $$CH_3-(CH_2)_n-CH_2-O-CH_2-\underset{\underset{OH}{|}}{CH}-CH_2-SO_3-M$$

wherein n is an integer of from 6 to 18; and M is sodium, potassium, calcium, magnesium or ammonium;

(b) less than 1.2%, preferably 0.1% to 1.0%, and desirably 0.6% to 1.0%, by weight of sodium chloride;

(c) about 30% to about 70% of an acyl isethionate of the formula $$RCOOCH_2CH_2SO_3M$$

wherein R is an aliphatic radical or mixed aliphatic radicals of a higher fatty acid, or mixtures thereof, having from six to eighteen carbon atoms and an iodine value of less than about 20; and wherein M is an alkali metal cation such as sodium, potassium or ammonium, or the cation of an organic amine base such as triethanolamine, tri-isopropanolamine, diethanolamine and monoethanolamine; and (d) about 1% to about 7% of an unesterified water-soluble alkali metal isethionate, for example, such as sodium isethionate, as a bar processing aid.

More particularly, a detergent bar according to the improvement herein comprises the following components in parts by weight:

| | Parts by Weight of Bar |
|---|---|
| a. Acyl isethionate | 35–55 |
| b. Higher fatty acid | 20–27 |
| c. Higher fatty acid soap | 5–15 |
| d. Sodium alkylbenzenesulfonate | 2–4 |
| e. Sodium isethionate | 1–4 |
| f. Sodium chloride | 0.1–1.0 |
| g. Alkoxy hydroxy propane sulfonate | 1–10 |
| h. Water | 3–6 |

wherein the higher fatty acid is selected from the group consisting of palmitic and stearic acid, the higher fatty acid soap is the sodium salt of an aliphatic monocarboxylic acid having from about 8 to about 18 carbon atoms, of which about 18–22% has 8–14 carbon atoms, the alkyl group of said alkylbenzenesulfonate is derived from a straight-chain hydrocarbon mixture having an average of about 13 carbon atoms; and the sum of (a) through (h) lies within the range of about 96 to about 100 parts by weight.

As a preferred embodiment, the toilet bars of the present invention comprise the following components in the proportions indicated:

| | Parts by Weight of Bar |
|---|---|
| a. Sodium acyl isethionate | 38–46 |
| b. Higher fatty acid | 21–25 |
| c. Higher fatty acid soap | 8–13 |
| d. Sodium alkylbenzenesulfonate | 1–3 |
| e. Sodium isethionate | 1–4 |
| f. Sodium chloride | 0.5–1.0 |
| g. Sodium alkoxy hydroxy propane sulfonate | 2–7 |
| h. Water | 3–6 |

wherein the acyl portion of said isethionate is derived from coconut oil, said higher fatty acid is selected from the group consisting of palmitic and stearic acids, said soap is the sodium salt of an aliphatic monocarboxylic acid having from about 8 to about 18 carbon atoms, of which about 18–22% has 8–14 carbon atoms, the alkyl portion of said alkylbenzenesulfonate is derived from a straight-chain hydrocarbon mixture having an average of about 13 carbon atoms; and the sum of (a) through (h) lies within the range of about 96 parts to about 100 parts by weight, the balance, if any, comprising minor additives, such as germicides, $TiO_2$, colorants and miscellaneous ingredients associated with the above-named components.

Particularly advantageous bars in accordance with the improvement herein have the following composition:

| | Parts by Weight of Bar |
|---|---|
| Sodium acyl isethionate a | 40–42 |
| Stearic acid | 20–23 |
| Coconut oil fatty acids | 2–3 |
| Soap of mixed tallow and coconut oil (b) | 9.5–10.5 |
| Coconut Oil[B] | |
| Sodium stearate | 2.5–3.5 |
| Sodium isethionate | 1–3 |
| Sodium alkeybenzenesulfonate c | 1.5–2.5 |
| Sodium chloride | 0.6–1.0 |
| Sodium alkoxy hydroxy propane Sulfonate[d] | 4–6 |
| $TiO_2$ | 0.1–0.3 |
| Germicides | 0–1.5 |
| Perfume | 0.7–1.7 |
| Colorants | 0.001–0.003 |
| Miscellaneous e | 1.5– |
| Water | 4-6 |

[a]the alkyl group is derived from coconut oil,
[b]about 75–85 parts tallow and about 15–25 parts coconut oil,
[c]the alkyl group is a straight chain having about 11–15 carbon atoms,
[d]the alkyl group is a straight chain having about 8–20 carbon atoms,
[e]inert matter unaboidably added in association with the components;

wherein the acyl portion of said sodium acyl isethionate is derived from coconut oil; and the alkyl portion of said sodium alkyl benzenesulfonate is derived from a straight-chain hydrocarbon mixture having about 11–15 carbon atoms.

The acyl isethionate component of the detergent bar may be prepared by methods well known to those skilled in the art. Suitable preparatory procedures may be found in U.S. Pat. Nos. 3,320,292; 3,376,229; 3,151,136; 3,383,396; 3,420,857; and 3,420,858.

The alkylbenzenesulfonates useful in the present invention may have a branched alkyl group of about 9 to about 15 carbon atoms such as may be derived from polypropylene as described in U.S. Pat. Nos. 2,477,382 and 2,477,383.

The alkyl group is preferably a straight chain having about 11 to about 15 carbon atoms and the sulfonated phenyl group is randomly positioned along the alkyl chain. Also useful are the alkylbenzenesulfonates described in U.S. Pat. Nos. 2,390,295; 3,320,174; and in Nos. 2,712,530 and 2,723,240.

The term "soap" is used herein in its popular sense i.e., the alkali metal salts of aliphatic alkane- or alkenemonocarboxylic acids. In general, the sodium soaps are used in the bars of the invention, but from about 1% to about 25% of the soap may be potassium soaps. The soaps useful herein are the well-known alkali-metal salts of natural or synthetic fatty (alkanoic or alkenoic) acids having about 12 to 20 carbon atoms, preferably about 12 to about 18 carbon atoms, and may be described as alkali-metal carboxylates of acyclic hydrocarbons having about 12 to about 20 carbon atoms.

Soaps having the fatty acid distribution of coconut oil may provide the lower end of the broad molecular weight range, while soaps having the fatty acid distribution of peanut or rapeseed oil, or their hydrogenated derivatives, may provide the upper end of the broad molecular weight range.

It is preferred to use the soaps having the fatty acid distribution of coconut oil or tallow, or mixtures thereof, since these are among the more readily available fats. The proportion of fatty acids having at least 12 carbon atoms in coconut oil soap is about 84%. This proportion will be greater when mixtures of coconut oil and fats such as tallow, palm oil, or non-tropical nut oils or fats are used, wherein the principal chain lengths are $C_{16}$ and higher. The preferred soap for use in the acyl isethionate detergent bar than has at least 84% fatty acids having about 12–18 carbon atoms.

It will be understood that the coconut oil employed for the soap, and for the isethionate as well, may be substituted in whole or in part by other "high-lauric" oils, that is, oils or fats wherein at least 50% of the total fatty acids are composed of lauric or myristic acids or mixtures thereof. These oils are generally exemplified by the tropical nut oils of the coconut oil class, such as palm kernel oil, babassu oil, ouricuri oil, tucum oil, cohune nut oil, murumuru oil, jaboty kernel oil, khakan kernel oil, dika nut oil, and for present purposes ucuhuba butter, a vegetable triglyceride high in myristic acid esters.

A preferred soap is a mixture of about 15% to about 20% coconut oil and about 80% to about 85% tallow. These mixtures contain about 95–96% fatty acids having about 12 to about 18 carbon atoms. The soap may be prepared from coconut oil, in which case the fatty acid content is about 84% of $C_{12}$–$C_{18}$ chain length.

The soaps may contain unsaturation in accordance with the commercially acceptable standards. Excessive unsaturation is normally avoided.

The soaps may be made by the well-known kettle boiling process from natural fats and oils such as tallow or coconut oil or their equivalents, by boiling with an alkali-metal hydroxide, using procedures well known to those skilled in the art. Alternatively the soaps may be made by neutralizing fatty acids, such as lauric ($C_{12}$), myristic ($C_{14}$), palmitic ($C_{16}$), or stearic ($C_{18}$) acids with an alkali-metal hydroxide or carbonate.

The sodium alkoxyhydroxy propane sulfonate may be prepared in accordance with the procedure described in U.S. Pat. No. 2,989,547.

The higher fatty acid component recited in the foregoing compositions is preferrably a commercial mixture of about 45% stearic acid and about 55% palmitic acid.

The rate at which a toilet detergent bar wears away during use is quantitatively determined by measuring the rate at which the tablet wears during a standardized washing procedure, referred to hereinafter as the "Wear Rate Test", whereby the weight of the bar consumed per use is determined. The Wear Rate Test is conducted in accordance with the description given below. It will be understood that the results obtained by this test may vary slightly from operator to operator and may show variations from day to day, but that the results obtained on tablets tested as a group by the same operator may be validly compared. For this reason, control bars are tested along with the bars of each Example herein.

Wear Rate Test

Equipment a. Smooth flat-bottomed plastic soap dishes, b. Pin rack or other point support for drying bars, c. Gallon container marked at ½ gallon.

Procedure

The test begins on the morning of Day 1, and terminates on the morning of Day 3. The initial weight of the bar to the nearest 0.01 gram is recorded. One half gallon of tap water at 105° F. is poured into a porcellain sink. The hands and bar are submerged in the 105° F. water, the bar and hands removed, and the bar rotated 20 times between the hands (1 rotation = 180°). The same procedure is repeated by submerging the bar and hands in the water, removing the bar and hands, and the above-described washing (20 rotations) repeated. The bar and hands are again submerged in the water, the bar removed from the hands and placed in the dish. The above-described washing is repeated 4 times during the day on Day 1, and again on Day 2.

Tap water at 80° F. is added to the dish prior to placing the bar in the dish following the first and last washing on Day 1 and Day 2 (6½ ml of tap water for regular size, 2½ ml of tap water for bath size.)

On the morning of Day 3, the bar is washed as before, rinsed in the wash water, and placed on pin rack to dry. The bar is dried at least 4 hours and weighed to the nearest 0.01 gram.

Calculation

Calculate the weight in grams used per wash as follows:

$$\frac{\text{Initial weight in grams} - \text{final weight in grams}}{\text{number of washes}} = \text{grams per use}$$

Panel Lather Test

Twenty panelists, each with a control bar and an experimental bar, wash each bar umder the following set of water hardness and temperature conditions in separate sinks:

a. Edgewater, N.J. water (90–100 ppm hardness as $CaCO_3$ at 75° F.)

b. 180 ppm hardness as $CaCO_3$ at 75° F., and c. 180 ppm hardness as $CaCO_3$ at 105° F.

Each panelist washes his hands in his customary manner under the aforementioned conditions and makes a preference for either the control or experimental detergent toilet bar based on lather volume within each test condition. The panelist may also rate the bars equal if they perceive lathering parity. Therefore, the higher the preference for a product the higher the number.

The invention may be more thoroughly understood by reference to the following Examples, which are to be considered illustrative, but not limitative, of the improvement herein.

EXAMPLE 1

This Example describes the preparation of sodium acyl isethionate detergent active.

5750 pounds of sodium acyl isethionate having 75% active detergent matter are prepared in the following manner:

2965 lbs. of coconut fatty acids and 833 lbs. of fatty acids recovered in the stripping step of a previously prepared batch of fatty acid isethionate are combined in a scale tank. A slurry containing approximately 75% by weight of sodium isethionate on a 100% pure basis are charged into a stock tank. Finally, 8 lbs. of zinc oxide are prepared as an aqueous slurry in another tank.

All of the foregoing ingredients are charged into a reactor and heated to a temperature of about 450° F. by circulating the contents of the reactor through a heat exchanger via a pump.

When the temperature of the reaction mixture reaches about 380°–400° F., water evolved by the reaction, together with steam distilled fatty acids, begin to distill from the reactor. These vapors are then condensed in a condenser. The fatty acids and water condensate are collected in a separator wherein the fatty acids are decanted via a pipe and accumulated in a collecting tank.

The reaction is essentially complete in approximately 150 minutes at 450°–460° F., when both fatty acids and water cease to accumulate in the separator.

At this point, the reaction mixture is drained into a stripper which is also purged with nitrogen to maintain an oxygen-free atmosphere. By circulating a heat transfer liquid through the jacket of the stripper, the temperature of the reaction mixture is maintained between about 430° and 460° F.

A vacuum is applied by means of ejectors to obtain a vacuum of about 20 inches of mercury. After maintaining this vacuum for a period of about 15 minutes, 963 lbs. of molten stearic acid is charged into the stripper to maintain the fluidity of the reaction product therein after the initial portion of unreacted fatty acids is removed. The removal of the unreacted fatty acids of the charged stock is completed by further increasing the vacuum to about 27½ inches of mercury and maintaining it at this level, while the mass in the stripper is maintained at 450° F. for a period of about 45 minutes. At this point, the pressure is brought back to atmospheric by shutting off the vacuum ejectors and introducing nitrogen into the stripper.

The fatty acids collected during the stripping are returned to the fatty acid charged tank for reuse in subsequent reactions.

After analyzing the completed batch of acyl isethionate, the reaction product, weighing 5750 lbs., is discharged and flash-cooled. The analysis shows that the acyl isethionate content is about 75.0%, corresponding to a yield of about 92% based on the isethionate charged to the reactor.

EXAMPLE 2

This Example describes the preparation of a detergent bar having the acyl isethionate of Example 1.

A Day mixer is charged with the appropriate amounts of stearic/palmitic acid (45:55 ratio by weight - Emersol 132), soap, sodium stearate, sodium alkyl ($C_{13}$-average) benzene sulfonate and sodium chloride, followed by the flash cooled acyl isethionate of Example 1 to give the composition on a percent by weight basis set forth below in Table A. These ingredients are mixed at 225° F. for approximately 60 minutes. The composite is discharged onto a chilled rotating drum and processed into chips. The chips are then charged into a chip mixer to which perfume and $TiO_2$ are milled and plodded into bar form.

Table A

| Example No.<br>Box Code No. | NS4207<br>(Control) | 2B<br>NS4208 | 2C<br>NS4209 |
|---|---|---|---|
| Composition | % by weight | % by weight | % by weight |
| Acyl isethionate of Example 1 (active basis) | 50.00 | 47.00 | 45.00 |
| Stearic/palmitic acid | 21.86 | 24.11 | 25.61 |
| Coconut oil fatty acids | 3.08 | 2.90 | 2.77 |
| Soap of mixed tallow and coconut oil | 9.07 | 9.82 | 10.32 |
| Sodium stearate | 3.00 | 3.00 | 3.00 |
| Sodium isethionate | 1.91 | 1.80 | 1.72 |
| Sodium alkylbenzene sulfonate | 2.03 | 2.03 | 2.03 |
| Sodium chloride | 0.85 | 0.85 | |
| Water | 5.25 | 5.25 | 5.25 |
| $TiO_2$ | 0.20 | 0.20 | 0.20 |
| Perfume | 1.00 | 1.00 | 1.00 |
| Miscellaneous | 1.75 | 2.04 | 2.25 |
| | 100.00 | 100.00 | 100.00 |

The detergent toilet bar having the above compositions were tested for wear rate and lather by the aforementioned procedures. The results are listed in Table B.

TABLE B

Effects of reducing acyl isethionate/sodium isethionate in detergent toilet bars.

Wear Rate

| Example No. | Wear Rate (gms/wash) |
|---|---|
| 2A - 50% acyl isethionate (control) | 3.40+0.14 |
| 2B - 47% acyl isethionate | 3.15+0.09 |
| 2C - 45% acyl isethionate | 2.76 +0.17 |

Panel Lathering

| | Wash Conditions | | | |
|---|---|---|---|---|
| | 75° F.<br>90 ppm $CaCO_3$ | 750° F.<br>180 ppm | 105° F.<br>180 ppm | Overall Results |
| 2A - 50% acyl isethionate (control) | 11 | 11 | 13 | 35 |
| 2B - 47% acyl isethionate | 8 | 8 | 6 | 22 |
| 2A and 2B EQUAL in lather | 1 | 1 | 1 | 3 |
| 2A - 50% acyl isethionate (control) | 11 | 13 | 11 | 35 |
| 2C - 45% acyl isethionate | 6 5 | 7 | 18 | |
| 2A and 2C EQUAL in lather | 3 | 2 | 2 | 7 |

The above data shows that decreasing the acyl isethionate/sodium isethionate in conjunction with a corresponding increase in stearic/palmitic acid and soap will significantly reduce the wear rate of the detergent toilet bar. However, the panel lathering data demonstrates that the panelist perceived a reduction in lathering in the low acyl isethionate/reduced wear rate bars as compared with the control bars.

EXAMPLE 3

This example illustrates the effect that sodium alkoxy hydroxy propane sulfonate prepared from Neodol 25 having an alkyl group=$C_{12}$-$C_{15}$ and NaCl, has on reduced acyl isethionate detergent toilet bars.

Detergent toilet bars having the following composition were prepared. All percentages are given on the basis of weight of the total bar.

Table C

| Example No.<br>Bar Code No. | 3A<br>NS4251<br>(Control) | 3B<br>NS4252 | 3C<br>NS4253 |
|---|---|---|---|
| Composition | % | % | % |
| Acyl isethionate of Example 2 (active basis) | 50.00 | 45.00 | 41.00 |
| Sodium alkoxy hydroxy propane sulfonate (alkyl group consist of $C_{12}$—$C_{15}$) | — | 2.00 | 5.00 |
| Stearic/palmitic acid | 20.16 | 24.11 | 24.86 |
| Coconut oil fatty acid | 3.08 | 2.77 | 2.53 |
| Soap of mixed tallow and coconut oil | 8.50 | 9.82 | 10.07 |
| Sodium stearate | 3.00 | 3.00 | 3.00 |
| Sodium isethionate | 4.68 | 1.72 | 1.56 |
| Sodium alkylbenzene sulfonate | 2.03 | 2.03 | 2.03 |
| Sodium chloride | 0.35 | 0.85 | 0.85 |
| Water | 5.25 | 5.25 | 5.25 |
| $TiO_2$ | 0.20 | 0.20 | 0.20 |
| Perfume | 1.00 | 1.00 | 1.00 |
| Miscellaneous | 1.75 | 1.75 | 1.75 |
| | 100.00 | 100.00 | 100.00 |

The detergent toilet bars having the above compositions are tested for wear rate and lather properties by the aforementioned procedures. The results are listed in Table D below.

Table D.

Effect of appropriate amounts of sodium alkoxy hydroxy propane sulfonate ($C_{12}$-$C_{15}$) and NaCl in reduced acyl isethionate/sodium isethionate detergent toilet bars.

Wear Rate

| Example No. | Wear Rate (grams/wash) |
|---|---|
| 3A - 50% acyl isetionate (control) | 3.72 ± 0.21 |
| 3B - 45% acyl isethionate + 2% sodium alkoxy hydroxy propane sulfonate | 3.15 ± 0.10 |
| 3C - 41% acyl isethionate + 5% sodium alkoxy hydroxy propane sulfonate | 3.16 ± 0.06 |

Panel Lathering

Wash Conditions
75° F./

Table D.-continued

Effect of appropriate amounts of sodium alkoxy hydroxy propane sulfonate ($C_{12}$-$C_{15}$) and NaCl in reduced acyl isethionate/sodium isethionate detergent toilet bars.

| Example No. | 180 ppm $CaCO_3$ | 105° F./ 180 ppm | Overall Results |
|---|---|---|---|
| 3A- Control | 9 | 10 | 19 |
| 3B - 45% acyl isethionate + 2% sodium alkoxy hydroxy propane sulfonate | 1 | 8 | 19 |
| 3A and 3B EQUAL in lather | — | 2 | 2 |
| 3A - Control | 12 | 8 | 20 |
| 3C - 41% acyl isethionate + 5% Sodium alkoxy hydroxy propane sulfonate | 8 | 10 | 18 |
| 3A and 3C EQUAL in lather | — | 2 | 2 |

Table D demonstrates that reducing the acyl isethionate/sodium isethionate in conjunction with the incorporation of sodium alkoxy hydroxy propane sulfonate and an appropriate amount of NaCl will significantly reduce the wear rate of the detergent bar. It was illustrated in Table B that a reduction in wear rate (reduced acyl isethionate/sodium isethionate and NaCl added) will adversely affect the lathering properties of the bar. However, Table D demonstrates that lathering parity is obtained between the control and lowered acyl isethionate/sodium isethionate detergent toilet bars when an appropriate amount of sodium alkoxy hydroxy propane sulfonate is incorporated into the formulation.

EXAMPLE 4

A straight chain sodium alkoxy hydroxy propane sulfonate having chain lengths of $C_{10}$ and $C_{18}$ was prepared, and the following acyl isethionate detergent bars were formulated based on the same:

Table E

| Example No. Bar Code No. | 4A NS4266 (control) | 4B NS4267 | 4C NS4268 |
|---|---|---|---|
| Composition | | | |
| Acyl isethionate of Example 1 (active basis) | 50.00 | 41.00 | 41.00 |
| Sodium alkoxy hydroxy propane sulfonate ($C_{10}$) | — | 5.00 | — |
| Sodium alkoxy hydroxy propane sulfonate ($C_{18}$) | — | — | 5.00 |
| Stearic/palmitic acid | 20.16 | 24.86 | 24.86 |
| Coconut oil fatty acid | 3.08 | 2.53 | 2.53 |
| Soap of mixed tallow and coconut oil | 8.50 | 10.07 | 10.07 |
| Sodium stearate | 3.00 | 3.00 | 3.00 |
| Sodium isethionate | 4.68 | 1.56 | 1.56 |
| sodium alkylbenzene sulfonate | 2.03 | 2.03 | 2.03 |
| Sodium chloride | 0.35 | 0.85 | 0.85 |
| Water | 5.25 | 5.25 | 5.25 |
| $Tio_2$ | 0.20 | 0.20 | 0.20 |
| Perfume | 1.00 | 1.00 | 1.00 |
| Miscellaneous | 1.75 | 2.65 | 2.65 |
| | 100.00 | 100.00 | 100.00 |

The detergent toilet bars having the above compositions were tested for wear rate and lather characteristics by the aforementioned procedures. The results are listed below in Table F.

Table F

Effect of appropriate amounts of sodium alkoxy hydroxy propane sulfonate ($C_{10}$ and $C_{18}$) and NaCl in reduced acyl isethionate/sodium inethionate detergent toilet bars Wear Rate

| Example No. | Wear Rate (grams/wash) |
|---|---|
| 4A - 50% acyl isethionate (control) | 3.95 ± 0.17 |
| 4B - 41% acyl isethionate + 5% sodium alkoxy hydroxy propane sulfonate ($C_{10}$) | 3.58 ± 0.11 |
| 4C - 41% acyl isethionate + 5% sodium alkoxy hydroxy propane sulfonate ($c_{18}$) | 3.44 ± 0.12 |

Panel Lathering

| Example No. | Wash Conditions 75° F./ 90 ppm $CaC0_3$ | 75° F./ 180 ppm | 105° F./ 180 pp, | Over - all Results |
|---|---|---|---|---|
| 4A - 50% acyl isethionate (control) | 4 | 9 | 7 | 20 |
| 4B - 41% acyl isethionate +5% sodium alkoxy hydroxy propane sulfonate ($C_{10}$) | 16 | 11 | 13 | 40 |
| 4A and 4B EQUAL in lather | — | — | — | — |
| 4A - 50% acyl isethionate (control) | 9 | 9 | 9 | 27 |
| 4C - 41% acyl isethionate + 5% sodium alkoxy hydroxy ether sulfonate ($C_{18}$) | 8 | 11 | 10 | 29 |
| 4A and 4C EQUAL in lather | 3 | 0 | 1 | 4 |

The data presented in Table F demonstrates that the sodium alkoxy hydroxy propane sulfonate/sodium chloride combination in lowered acyl isethionate/-sodium isetionate toilet detergent bars results in a significantly improved wear rate without an adverse effect in lathering properties of the bar.

EXAMPLE 5

This Example demonstrates the effect of the addition of an appropriate amount of an alkoxy hydroxy propane sulfonate on a lowered acyl isethionate/sodium isethionate detergent bar, with and without the inclusion of NaCl.

Table G

| Example No. Bar Code No. | 5A NS4317 (Control) | 5B NS4314 (no salt) | 5C NS4315 |
|---|---|---|---|
| Composition | | | |
| Acyl isethionate of Example 1 (active basis) | 50.00 | 41.00 | 41.00 |
| Sodium alkoxy hydroxy propane sulfonate $C_{14}$ | — | 5.00 | 5.00 |
| Stearic/palmitic acid | 20.16 | 25.50 | 24.86 |
| Coconut oil fatty acid | 3.08 | 2.53 | 2.53 |
| Soap of mixed tallow and coconut oil | 8.50 | 10.28 | 10.07 |
| Sodium stearate | 3.00 | 3.00 | 3.00 |
| Sodium isethionate | 4.68 | 1.56 | 1.56 |
| Sodium alkylbenzene sulfonate | 2.03 | 2.03 | 2.03 |
| Sodium chloride | 0.35 | — | 0.85 |
| Water | 5.25 | 5.25 | 5.25 |
| $TiO_2$ | 0.20 | 0.20 | 0.20 |
| Perfume | 1.00 | 1.00 | 1.00 |
| Miscellaneous | 1.75 | 2.65 | 2.65 |
| | 100.00 | 100.00 | 100.00 |

The detergent toilet bars having the above composition, were tested for wear rate and lather characteristics by the aforementioned procedures. The results are listed below in Table H.

Table H

Effect of appropriate amounts of sodium alkoxy hydroxy propane sulfonate with and without NaCl in lowered acyl isethionate/sodium isethionate toilet detergent bars.

Wear Rate

| Example No. | Wear Rate (grams/wash) |
|---|---|
| 5A - 50% acyl isethionate (control) | 2.93 ± 0.12 |
| 5B - 41% acyl isethionate + 5% sodium alkoxy hydroxy propane sulfonate($C_{14}$) (no salt) | 3.05 ± 0.18 |
| 5C - 41% acyl isethionate + 5% sodium alkoxy hydroxy propane sulfonate ($C_{14}$) (.85% salt) | 2.47 ± 0.18 |

Panel Lathering

| Example No. | Wash Conditions 75° F./ 90 ppm $CaCO_3$ | 75° F./ 180 ppm | 105° F./ 180 ppm | Overall Results |
|---|---|---|---|---|
| 5A - 50% acyl isethionate (control) | 4 | 5 | 5 | 14 |
| 5B - 41% acyl isethionate +5% sodium alkoxy hydroxy propane sulfonate ($C_{14}$) (no salt). | 4 | 4 | 4 | 12 |
| 5A and 5B EQUAL in lather | 2 | 1 | 1 | 4 |
| 5A - 50% acyl isethionate (control) | 5 | 4 | 3 | 12 |
| 5C - 41% acyl isethionate +5% Sodium alkoxy hydroxy ether sulfonate ($C_{14}$) (.85% salt) | 5 | 5 | 7 | 17 |
| 5A and 5C EQUAL in lather | — | 1 | — | 1 |

The data presented in Table H demonstrates that the incorporation of an alkoxy hydroxy propane sulfonate into a lowered acyl isethionate/sodium isethionate detergent bar gives lathering parity with a detergent bar having no reduction in the acyl isethionate/sodium isethionate content (5A vs. 5B). However, the wear rate of detergent bar 5B was determined to be practically equally as high as the wear rate of detergent bar 5A.

On the other hand, when detergent bars 5A and 5C were compared, the latter having incorporated therein appropriate amounts of alkoxy hydroxy propane sulfonate and sodium chloride, a significant reduction in wear rate was observed while at the same time maintaining lathering parity with detergent bar 5A.

What is claimed is:

1. A method for reducing the wear rate of an acyl isethionate detergent bar having an unesterified water-soluble alkali metal isethionate as a bar processing aid, without adversely affecting the lathering properties of the bar, which comprises incorporating into said bar:

(a) from about 2% to 6% by weight of an alkoxy hydroxy propane sulfonate having the formula:

$$CH_3-(CH_2)_n-CH_2-O-CH_2-\underset{\underset{OH}{|}}{CH}-CH_2-SO_3-M$$

wherein n is an integer from 6 to 18; and M is sodium, potassium, calcium, magnesium or ammonium; and (b) less than 1.2% by weight of sodium chloride;

the percentages being based on the total weight of the acyl isethionate detergent bar produced.

2. The method according to claim 1 wherein the sodium chloride is incorporated into the acyl isethionate detergent bar in an amount of from 0.1% to 1.0% by weight.

3. The method according to claim 1 wherein the sodium chloride is incorporated into the acyl isethionate detergent bar in an amount of from 0.6% to 1.0% by weight.

4. The method according to claim 1 wherein the alkoxy hydroxy propane sulfonate and sodium chloride is incorporated into an acyl isethionate detergent bar comprising (a) from about 30% to 70% of an acyl isethionate of the general formula:

$$RCOOCH_2CH_2SO_3M$$

wherein R is an aliphatic radical or mixed aliphatic radicals of a higher fatty acid, or mixtures thereof, having from six to eighteen carbon atoms and an iodine value of less than about 20; and M is an alkali metal cation or the cation of an organic amine of triethanolamine, tri-isopropanolamine, diethanolamine, or monoethanolamine;

(b) from about 1% to about 7% of an unesterified water-soluble alkali metal salt of isethionic acid;

(c) from about 2% to 10% of at least one water-soluble suds-boosting detergent salt selected from the group consisting of alkali metal and organic amine higher aliphatic fatty alcohol sulfates, an alkyl aryl sulfonate, and a higher aliphatic fatty acid tauride;

(d) from about 1% to about 9% water;

(e) from about 2.5% to 25% of a water-soluble higher fatty acid soap; and (f) from about 10% to 40% of at least one higher fatty acid having from about 12 to 25 carbon atoms as a binder and plasticizer;

thereby forming a detergent bar having a pH within the range of from 6 to 8 measured as a 10% aqueous solution of the composition at 35° C.

5. The method according to claim 4 wherein the acyl isethionate is sodium acyl isethionate, the acyl portion being derived from coconut oil, and the salt of isethionic acid is sodium isethionate.

6. The method according to claim 1 wherein the alkoxy hydroxy propane sulfonate is sodium-3-alkoxy-2-hydroxy-1-propane sulfonate, the alkyl group having 12 to 15 carbon atoms.

7. An acyl isethionate toilet detergent bar comprising:

(a) from about 30% to 70% of water-soluble alkali metal detergent salt of esters of isethionic acid with mixed aliphatic fatty acids having from six to eighteen carbon atoms and an iodine value of less than 20, of which mixed acids at least 75% have from twelve to eighteen carbon atoms and up to 25% have from six to ten carbon atoms;

(b) from 2 to 10% of at least one water-soluble suds-boosting detergent salt selected from the group consisting of alkali metal and organic amine higher aliphatic fatty alcohol sulfates, alkyl aryl sulfonates, and the higher aliphatic fatty acid taurides;

(c) from about 1% to about 9% water;

(d) from about 2.5% to about 25% of a water-soluble higher fatty acid soap;

(e) from about 10 to 40% of at least one higher fatty acid having from twelve to about twenty-five carbon atoms as a binder and plasticizer;

(f) about 0.1% to about 1.0% sodium chloride;

(g) about 2% to about 6% of an alkoxy hydroxy propane sulfonate where the alkyl group consists of $C_8$ to $C_{20}$, or mixtures thereof; and (h) from about 1% to about 7% of an unesterified water-soluble alkali metal salt of isethionic acid;

said bar having a pH within the range of about 6 to about 8 measured as a 10% aqueous solution of the bar composition at 35° C.

8. The toilet detergent bar of claim 7 wherein said alkoxy hydroxy propane sulfonate is sodium-3-alkoxy-2-hydroxy-1-propane sulfonate having an alkyl chain length of $C_8$.

9. The toilet detergent bar of claim 7 wherein said alkoxy hydroxy propane sulfonate is sodium-3-alkoxy-2-hydroxy-1-propane sulfonate having an alkyl chain length of $c_{20}$.

10. An acyl isethionate toilet detergent bar comprising in parts by weight:

| | |
|---|---|
| a. Sodium acyl isethionate | 35–55 |
| b. Higher fatty acid | 20–27 |
| c. Soap of a higher fatty acid | 5–15 |
| d. Sodium isethionate | 1–4 |
| e. Sodium alkylbenzenesulfonate | 2–4 |
| f. Sodium chloride | 0.1–1.0 |
| g. Sodium alkoxy hydroxy propane sulfonate | 2–6 |
| h. Water | 3–6 |

wherein the acyl portion of said isethionate is derived from coconut oil; said fatty acid is selected from the group consisting of palmitic and stearic acids; said soap is the sodium salt of an aliphatic monocarboxylic acid having from about 8 to about 18 carbon atoms, of which about 18–22% has 8–14 carbon atoms; the alkyl group of said alkylbenzenesulfonate is derived from a straight-chain hydrocarbon mixture having an average of about 13 carbon atoms; and the sum of (a) through (h) lies within the range of about 96 to about 100 parts by weight.

11. An acyl isethionate toilet detergent bar comprising in parts by weight, based on 100 parts by weight of the total composition,

| | |
|---|---|
| a. Sodium acyl isethionate | 40–42 |
| b. Stearic acid | 20–23 |
| c. Coconut oil fatty acids | 2–3 |
| d. Soap of mixed tallow and coconut oil | 9.5–10.5 |
| e. Sodium stearate | 2.5–3.5 |
| f. Sodium isethionate | 1–3 |
| g. Sodium alkylbenzenesulfonate | 1.5–2.5 |
| h. Sodium chloride | 0.5–1.0 |
| i. Sodium alkoxy hydroxy propane sulfonate | 4–6 |
| j. $TiO_2$ | 0.1–0.3 |
| k. Germicide | 0–1.5 |
| l. Mineral Oil | 0–1.5 |
| m. Perfume | 0.7–1.7 |
| n. Colorant | 0.001–0.003 |
| 0. Water | 4–6 |

wherein the acyl portion of said sodium acyl isethionate is derived from coconut oil; the alkyl portion of said sodium alkylbenzenesulfonate is derived from a straight-chain hydrocarbon mixture having about 11–15 carbon atoms; and said mixed tallow and coconut oil comprises from about 75–85 parts tallow and about 15–25 parts coconut oil.

* * * * *

UNITED STATES PATENT AND TRADEMARK OFFICE

CERTIFICATE OF CORRECTION

PATENT NO. : 4,180,470

DATED : December 25, 1979

INVENTOR(S) : Richard Tokosh, Arno Cahn

It is certified that error appears in the above-identified patent and that said Letters Patent are hereby corrected as shown below:

Page 1, Inventors: Change "Richard Tokosh, Saddle Brook; Arno Cahn, Pearl River, both of N.J." to read -- Richard Tokosh, Saddle Brook, N.J.; Arno Cahn, Pearl River, N.Y. --

Column 1, line 12: Delete "predominate" and substitute therefore -- predominant --.

Column 3, line 63: Delete "orgainic" and substitute therefore -- organic --.

Column 5, line 36: Delete "isethionate a" and substitute therefore -- isethionate[a] --.

Column 5, line 39: Delete "oil (b)" and substitute therefore -- oil[b] --.

Column 5, line 40: Delete "Coconut Oil[B]".

Column 5, line 43: Delete "alkeybenzenesulfonate c" and substitute therefore -- alkylbenzenesulfonate[c] --.

Column 5, lines 47-48: Between "Germicides" and "Perfume" add the words -- Mineral Oil 0-1.5 --.

Column 5, line 49: Delete "Miscellaneous e 1.5-" and substitute therefore -- Miscellaneous[e] 1.5-3 --.

Column 5, footnote e: Delete "unaboidably" and substitute therefore -- unavoidably --.

Column 6, line 35: Delete "than" and substitute therefore -- then --.

UNITED STATES PATENT AND TRADEMARK OFFICE

CERTIFICATE OF CORRECTION

PATENT NO. : 4,180,470

DATED : December 25, 1979

INVENTOR(S) : Richard Tokosh, Arno Cahn

It is certified that error appears in the above-identified patent and that said Letters Patent are hereby corrected as shown below:

Column 7, line 2: Delete "preferrably" and substitute therefore -- preferably --.

Column 9, line 15: In table A column 1 add -- 2A -- in line with "Example No."

Column 9, line 25: In table A in column of example 2C for sodium chloride, add -- 0.85 --.

Column 9, Table B: On the line of example 2A the result "3.40 ± 0.14" should appear in the column of "Wear Rate".

Column 9, line 32: Delete "bar" and substitute therefore -- bars --.

Column 9, Table B: "Panel Lathering" under Example No. is the heading for the table below and therefore should be moved to the middle of the column.

Column 9, second half of Table B: Delete the temperature in the second column "750°F" and substitute therefore -- 75°F --.

Column 9, second half of Table B: Separate line 3 i.e. "2A and 2B Equal in lather" from line 4 i.e. "2A - 50% acyl isethionate" by blank space.

Column 9, second half of Table B: Delete the fifth line "2C - 45% acyl isethionate 65 7 18" and substitute therefore -- 2C - 45% acyl isethionate 6 5 7 18 --.

Column 10, lines 66 and 67: Delete "Panel Lathering" and "Wash Conditions, 75°F/" and add -- Panel Lathering -- in column 11 (Table D - cont'd) below "detergent toilet bars" as subheading.

UNITED STATES PATENT AND TRADEMARK OFFICE

CERTIFICATE OF CORRECTION

PATENT NO. : 4,180,470

DATED : December 25, 1979

INVENTOR(S) : Richard Tokosh, Arno Cahn

It is certified that error appears in the above-identified patent and that said Letters Patent are hereby corrected as shown below:

Add -- Wash Conditions -- on same line as "Example No." above the three result columns (same format as in Table F, column 12).

Column 11, line 7: Delete "180 ppm $CaCO_3$" and substitute therefore -- 75°F/180 ppm $CaCO_3$ -- i.e.

Panel Lathering

| Example No. | Wash Conditions | | |
|---|---|---|---|
| | 75°F/ 180 ppm $CaCO_3$ | 105°F/ 180 ppm | Overall Results |

Column 11, line 11: Delete "1" and substitute therefore -- 11 --

Column 11, lines 42, 43 and 44: Delete

| | 4A | 4B | 4C |
|---|---|---|---|
| "Example No. | | | |
| Bar Code No. | NS4266 (control) | NS4267 | NS4268 |

and substitute therefore:

| | | | |
|---|---|---|---|
| -- Example No. | 4A | 4B | 4C -- |
| Bar Code No. | NS4266 (control) | NS4267 | NS4268 |

Column 12, line 4: Delete "inethionate" and substitute therefore -- isethionate --.

UNITED STATES PATENT AND TRADEMARK OFFICE

CERTIFICATE OF CORRECTION

PATENT NO. : 4,180,470

DATED : December 25, 1979

INVENTOR(S) : Richard Tokosh, Arno Cahn

It is certified that error appears in the above-identified patent and that said Letters Patent are hereby corrected as shown below:

Column 12, line 14: Delete "$c_{18}$" and substitute therefore -- $C_{18}$ --.

Column 12, line 19: Delete "pp." and substitute therefore -- ppm --.

Column 12, line 25: Leave blank space between "4A and 4B EQUAL in lather" and "4A - 50% acyl isethionate (control)".

Column 12, line 36: Delete "isetionate" and substitute therefore -- isethionate --.

Column 12, line 48 (Table G): Move "Example No." and "Bar Code No." one line up to be in line with "5A" an "NS4317" respectively Column 15, line 16: Delete "$c_{20}$" and substitute therefore -- $C_{20}$ --.

Signed and Sealed this

*Thirteenth* Day of *May 1980*

[SEAL]

*Attest:*

SIDNEY A. DIAMOND

*Attesting Officer*

*Commissioner of Patents and Trademarks*